United States Patent [19]

Yamaguchi

[11] Patent Number: 4,716,405

[45] Date of Patent: Dec. 29, 1987

[54] FLAT PANEL DISPLAY CONTROL APPARATUS

[75] Inventor: Noboru Yamaguchi, Oome, Japan

[73] Assignee: Kabushiki Kaisha Toshiba, Kawasaki, Japan

[21] Appl. No.: 792,844

[22] Filed: Oct. 30, 1985

[30] Foreign Application Priority Data

Oct. 31, 1984 [JP] Japan ..... 59-229221

[51] Int. Cl.[4] ..... G09G 1/16

[52] U.S. Cl. ..... 340/723; 340/709; 340/724

[58] Field of Search ..... 340/703, 723, 724

[56] References Cited

U.S. PATENT DOCUMENTS

| | | | |
|---|---|---|---|
| 3,895,375 | 7/1975 | Williams | 340/723 |
| 4,398,190 | 8/1983 | Long et al. | 340/723 |
| 4,470,042 | 9/1984 | Barnich et al. | 340/723 |
| 4,520,356 | 5/1985 | O'Keefe et al. | 340/703 |

OTHER PUBLICATIONS

"Attribute Controller Display Modification", Nicholson, *IBM Technical Disclosure Bulletin,* 1978, vol. 21, No. 1, pp. 295–296.

Dot Matrix Display Using Liquid Crystal System (TN Type); Hitachi Limited; May 1979.

*Primary Examiner*—Howard A. Birmiel

*Attorney, Agent, or Firm*—Finnegan, Henderson, Farabow, Garrett & Dunner

[57] ABSTRACT

Disclosed is a flat panel display control apparatus which has the same number of dots as those of a CRT display device in the vertical and horizontal directions, has compatibility with the CRT display device, and displays each character by a plurality of dots in a matrix form. The flat panel display control apparatus has a video memory for storing character codes of characters to be displayed, a pattern generator for generating a character pattern corresponding to the character code generated from the video memory, an attribute data memory for storing attribute data for each character stored in the video memory, and an attribute controller for reading out the character pattern and the attribute data thereof so as to superimpose on the character pattern a lateral stripe pattern which repeatedly moves downward in a dot matrix constituting the character pattern when the attribute data indicates a high-light level of high-brightness display.

12 Claims, 15 Drawing Figures

SA (0 0 0)
(0 0 1)
(0 1 0)
(0 1 1)
(1 0 0)
(1 0 1)
(1 1 0)
(1 1 1)

CP (0 1 1 1 0 0)
(1 0 0 0 1 0)
(1 0 0 0 1 0)
(1 1 1 1 1 0)
(1 0 0 0 1 0)
(1 0 0 0 1 0)
(1 0 0 0 1 0)
(0 0 0 0 0 0)

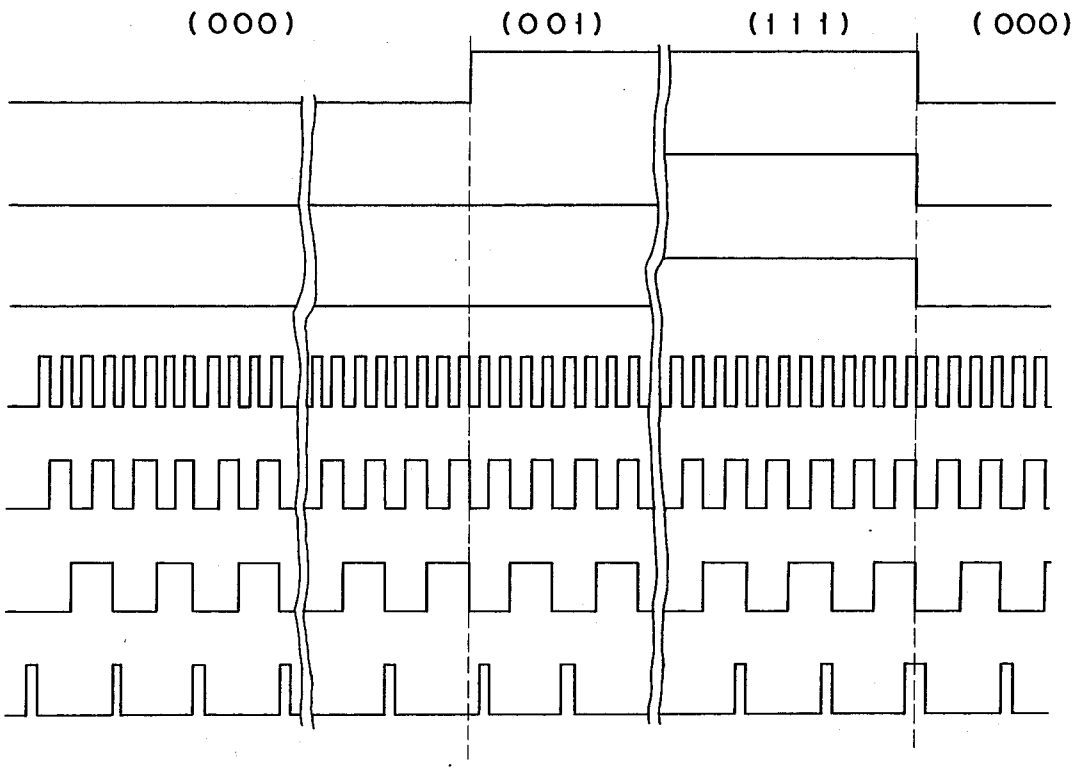
FIG. 5A (CTR "0")
FIG. 5B (CTR "1")
FIG. 5C (CTR "2")
FIG. 5D (SA "0")
FIG. 5E (SA "1")
FIG. 5F (SA "2")
FIG. 5G (COMP 53)

FLAT PANEL DISPLAY CONTROL APPARATUS

BACKGROUND OF THE INVENTION

The present invention relates to a flat panel display control apparatus and, more particularly, to an apparatus for controlling a flat panel display device which is compatible with a cathode-ray tube (to be referred to a CRT hereinafter) display device.

Conventionally, CRT display devices are most popular as display devices for personal computers. CRT display devices are superior to other display devices in terms of luminance, contrast and the like. However, since CRT display devices are heavy and large in size, they cannot be applied to handheld personal computers. Meanwhile, in addition to the CRT display device, flat panel display devices such as a liquid crystal display device (to be referred to as an LCD hereinafter), a plasma display device, an electro luminescent (EL) display device and the like are available. Although they were at first used for relatively compact devices, such as wristwatches, electronic calculators and the like, they can display the same number of dots as the CRT display device in keeping with the trend to enlarged display sizes in recent years. Thus, flat panel display devices are now used for handheld personal computers in place of CRT display devices.

However, in the computer field, it is important to provide software compatibility when new equipment is developed. When a newly developed computer does not have software compatibility with respect to a conventional computer, new software must be developed. In order to avoid such a need, newly developed computers are generally designed so that conventional computer software can be used.

In this context, the case of a newly developed personal computer with a flat panel display device having software compatibility with a conventional personal computer with a CRT display device will be considered. Although the CRT and flat panel display devices must have the same dot matrix configurations constituting one character and constituting one screen, these requirements can be easily realized by current technology. Display for emphasizing a part of a display by blink, reverse, underlining, and high-brightness display is performed by the CRT display device. Note that high-brightness display is employed to attract the attention of an operator by increasing luminance of a certain displayed character or portion among other displayed characters or portions. Since the flat panel display device can display in only a single color and has no gradation; blink, inversion and underlining can be performed as emphasized display. However, it is difficult to realize high-brightness display. Particularly, in an LCD, luminance is optimally pre-adjusted. For this reason, when the luminance or brightness is changed, it is difficult or impossible to watch a display image. This tendency becomes more notable as the LCD becomes larger in size. Therefore, even if a personal computer with a flat panel display device having software compatibility with a personal computer with a CRT display device were to be developed, such compatibility could not provide high-brightness display as an emphasized display. Since the current personal computer with a CRT display device frequently utilizes high-brightness display, if such display cannot be used in a personal computer with a flat panel display device, the corresponding portion would not be displayed, resulting in inconvenience and thereby impairing practical use.

SUMMARY OF THE INVENTION

It is an object of the present invention to provide a flat panel display control apparatus which can realize a high-brightness or high-light level display mode inherent in the CRT display device in a different mode in a flat panel display device and can realize compatibility between the flat panel and the CRT display devices.

In order to realize the above object of the present invention, there is provided a flat panel display control apparatus comprising a flat panel display device for displaying each character by a plurality of dots in a matrix form, pattern storing means for storing a character pattern of a character to be displayed, means for storing attribute data of each character stored in the pattern storing means, and attribute control means for reading out the character pattern and the attribute data thereof, and for supplying the character pattern to the flat panel display device through emphasizing processing when the attribute data indicates high-brightness display.

BRIEF DESCRIPTION OF THE DRAWINGS

FIGS. 5A to 5G are timing charts of various signals showing the operation of the attribute controller shown in FIG. 2;

DETAILED DESCRIPTION OF THE PREFERRED EMBODIMENTS

Figure 1:
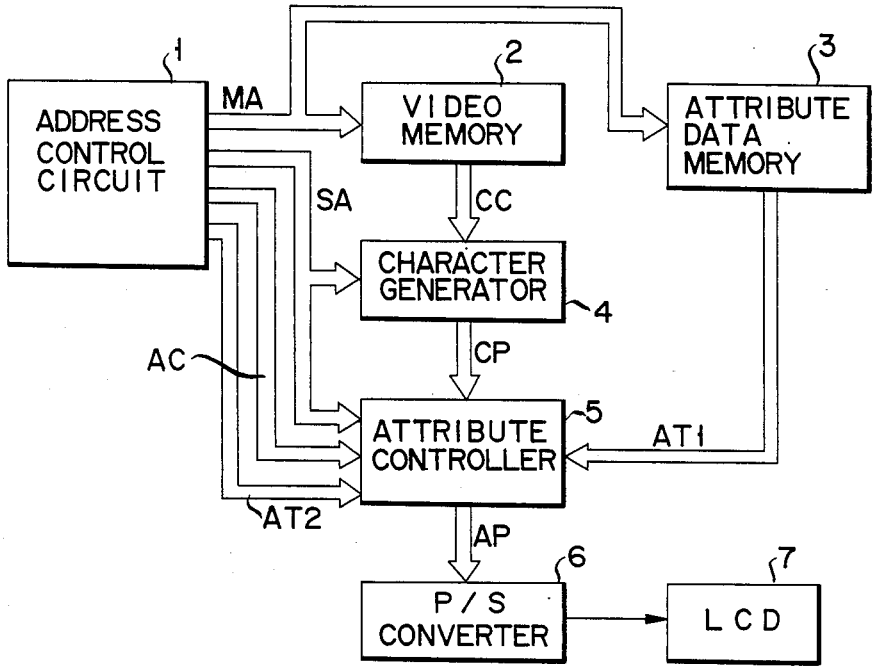
FIG. 1 is a block diagram showing a flat panel display control apparatus according to a first embodiment of the present invention.

A flat panel display control apparatus according to an embodiment of the present invention will be described with reference to the accompanying drawings. FIG. 1 is a block diagram showing an arrangement of the first embodiment according to the present invention. An address control circuit 1 supplies: a memory address MA to a video memory 2, an attribute data memory 3, a scanning line address SA (3 bits) to a character generator 4 and an attribute controller 5, and attribute control data AC to the controller 5. Character codes CC of characters to be displayed are written in the memory 2 in advance by a CPU (not shown). The memory 2 reads out the character code CC at an address designated by the memory address MA and supplies the readout character code CC to the generator 4. The memory 3 has the same number of addresses as those of the memory 2. Attribute data AT1 (i.e., a signal constituted by a plurality of bits each corresponding to a specific attribute) indicating various attributes is written in advance in the memory 3 by the CPU for each character stored in the memory 2. The memory 3 also reads out attribute data AT1 at an address designated by the memory address MA and supplies the readout data AT1 to the controller 5. Note that attribute data AT2 equivalent to the attribute data AT1 is supplied from the circuit 1 to the controller 5. This is to enable direct attribute control and indirect attribute control through the memory 3 both by the circuit 1. The generator 4 comprises a ROM for storing character patterns, and receives the character code CC and the scanning line address SA so as to supply a character pattern CP (6 bits) corresponding to one scanning line component of one character. The controller 5 adds to the character pattern CP from the generator 4 an attribute in accordance with the attribute control data AC and the attribute data AT1 from the attribute data memory 3 or AT2 from the circuit 1, and supplies a character pattern AP (6 bits) with the attribute data to an LCD 7 as a flat panel display device through a parallel to serial (P/S) converter (comprising a shift register) 6.

Figure 2:
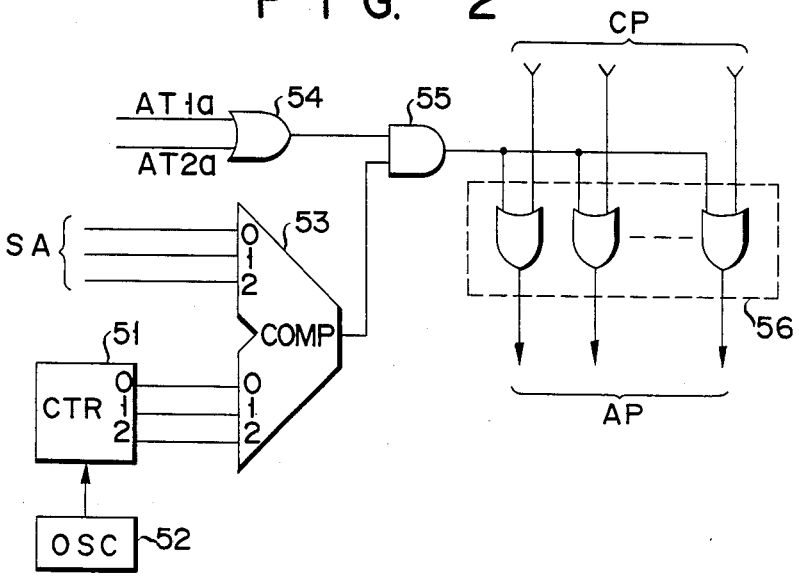
FIG. 2 is a detailed circuit diagram showing an attribute controller shown in FIG. 1.

FIG. 2 is a detailed circuit diagram of a portion of the attribute controller 5 which relates to high-luminance display attribute control. A clock signal from an oscillator 52 is supplied to a 3-bit binary ring counter 51. An oscillating frequency of the oscillator 52 is set to be considerably lower than the scanning frequency of the scanning line address SA, and a change in the scanning line address SA is considerably faster than the output of the counter 51. A bit-parallel output from the counter 51 is supplied to the first input terminals of a comparator 53. The second input terminals of the comparator 53 receive the bit-parallel scanning line address SA. The comparator 53 comprises EX-OR gates, and supplies a "1" coincidence signal to the first input terminal of an AND gate 55 upon detection of a coincidence between the two input signals. High-luminance display attribute bits AT1*a* and AT2*a* of the attribute data AT1 and AT2 are supplied to the second input terminal of the AND gate 55 through an OR gate 54. The bits AT1*a* and AT2*a* are set to "1" in the case of high-luminance display. The output from the AND gate 55 is supplied to first input terminals of an OR gate array 56 comprising six OR gates equal to the number of bits of the character pattern CP. The respective bits of the character pattern CP are supplied from the generator 4 to second input terminals of the OR gate array 56. The output signal from the OR gate array 56 corresponds to the character pattern AP with the attribute data.

Figure 3:
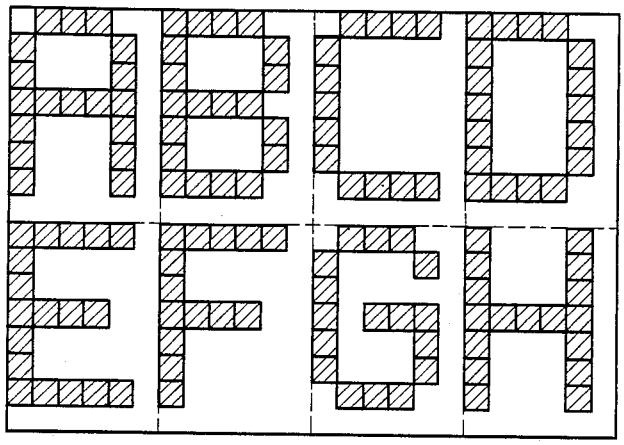
FIG. 3 is an illustration showing a screen configuration of an LCD as the flat panel display device of the first embodiment.

The operation of the first embodiment will be described hereinafter. The LCD 7 has a screen configuration of 4 (digits)×2 (lines), as shown in FIG. 3, and each character is displayed in an 8×6 dot matrix in the vertical and horizontal directions. When LCD 7 is two lines, as shown in FIG. 3, the character codes CC are written from the CPU into the memory 2 in the following manner. A character code indicating a letter "A" is written at an address "000" of the memory address MA, a character code indicating a letter "B" is written at an address "001" thereof, a character code indicating a letter "C" is written at an address "010" thereof, . . . , and similarly, a character code indicating a letter "H" is written at an address "111" of the address MA. In this case, the memory address MA and the scanning line address SA are generated from the circuit 1 in the following sequence to read out the character codes CC of one screen. Note that the first numeral in parentheses indicates the address MA and the second numeral indicates the address SA.

Figure 4:
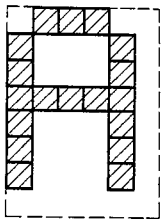
FIG. 4 is a view showing the relationship between scanning line addresses of an "A" character pattern and the character pattern data.

(000,000) → (001,000) → . . . → (011,000)
→ (000,001) → (001,001) → . . . → (011,001)
.
.
.
→ (000,111) → (001,111) → . . . → (011,111)
→ (100,000) → (101,000) → . . . → (111,001)
→ (100,001) → (101,001) → . . . → (111,001)
.
.
.
→ (100,111) → (101,111) → . . . → (111,111)
→ return to the beginning In the above sequence, at the first timing of MA="000" and SA="000", since the output character code CC from the memory 2, i.e., the input character code CC to the generator 4 indicates the letter "A" and the scanning line addess SA indicates a first line (an uppermost line), the character pattern CP generated from the generator 4 corresponds to a pattern of the first line of the letter "A". When the character pattern of the letter "A" is assumed to be a pattern as shown in FIG. 4, the character pattern CP generated from the generator 4 is "011100". When the attribute data is not present (i.e., when the bits AT1*a* and AT2*a* are "0"), the AND gate 55 shown in FIG. 2 is nonconductive and generates a "0" level output, so that the character pattern CP from the generator 4 is output from the OR gate array 56 as the character pattern AP with the attribute data. When the attribute bit other than the bit data AT1*a* and AT2*a* is present, the character pattern CP from the generator 4 is controlled by the controller 5 in accordance with the bit. The output signal AP from the controller 5 is supplied to the converter 6, and is serially generated therefrom by one bit, thus being subjected to display on the LCD 7. In this manner, the character pattern of the first line of the letter "A" is displayed. When MA="001" and SA="000", a pattern of the first line of the letter "B" is displayed. Similarly, patterns of the first line of the letters "C" and "D", those of the second, third, . . . , and eighth (lowermost) lines of the letter "A", "B", "C", and "D", those of the first (uppermost), second, . . . , and eighth (lowermost) lines of "E", "F", "G" and "H" are displayed. Then, the display returns to the first line of the letters "A", "B", "C" and "D", and these operations are repeated.

Figure 6:
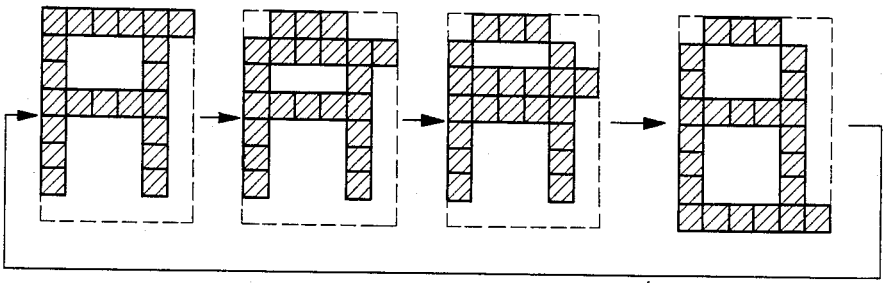
FIG. 6 is an illustration for explaining a high-luminance display mode according to the first embodiment.

The operation for adding the high-brightness display attribute to the letter "A" will be described below. In this case, attribute control is indirectly performed through the memory 3, and the attribute data is supplied only from the memory 3. The CPU writes in advance the attribute data indicating high-luminance display (the attribute bit AT1*a*="1") at the memory address MA="000" of the memory 3, and attribute data indicating non-high-brightness display (AT1*a*="0") at the address MA="001" to "111". As described above, since the oscillating frequency of the oscillator 52 is set to be considerably lower than the scanning frequency of the scanning line address SA, a change in output from the counter 51 becomes slower than that in the address SA. FIGS. 5A to 5C respectively show the output data bits 0, 1 and 2 of the counter 51, and FIGS. 5D to 5F respectively show data bits 0, 1 and 2 of the scanning line address SA. Thus, the "1" coincidence signal is generated from the comparator 53 once a period of the scanning line address SA, as shown in FIG. 5G. When the memory address MA="000", since the bit AT1*a* indicating high-brightness display is "1" level, the AND gate 55 is conductive, and the "1" coincidence signal from the comparator 53 is supplied to the first input terminals of the OR gate array 56 through the AND gate 55. When the address MA="000", all the outputs AP from the array 56 are "1" level irrespective of the character pattern CP at any address SA, and then a lateral stripe is displayed on the LCD 7. When the output from the counter is "000", the coincidence signal is generated every time the address SA is "000". However, when the output from the counter 51 is "001", the coincidence signal is generated every time the scanning line address SA is "001". As the output from the counter 51 is changed, when the address SA is changed as "010", "011",..., "111", "001",..., the lateral stripe is displayed. For this reason, the lateral stripe moves downward and returns to the uppermost line after reaching the lowermost line, i.e., the stripe is vertically circulated, as shown in FIG. 6.

In this manner, according to the first embodiment, emphasized display instead of high-luminance display can be performed such that the lateral stripe is superimposed on the displayed character "A" while vertically moving on the character. Thus, a control apparatus for a flat panel display device having full compatibility with a CRT display device can be realized simply by adding a small amount of hardware.

Figure 7:
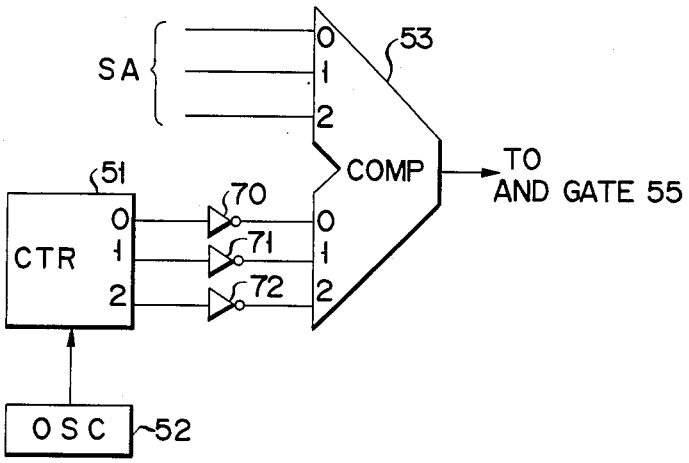
FIG. 7 is a view showing a first modification of the first embodiment.
Figure 8:
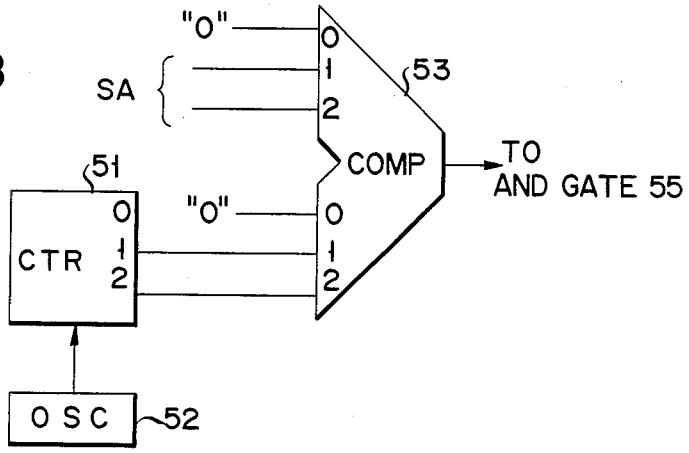
FIG. 8 is a view showing a second modification of the first embodiment.

In the first embodiment, the lateral stripe of one line repeatedly moves downward, but the present invention is not limited to this. As shown in FIG. 7, when the respective output bits of the counter 51 are supplied to the comparator 53 through inverters 70, 71 and 72, the moving direction of the lateral stripe is reversed. As shown in FIG. 8, when only the output bits 1 and 2 of the counter 51 are supplied to the first input terminals of the comparator 53, the bits 1 and 2 of the scanning line address SA are supplied to the second input terminals of the comparator 53, and the bits 0 of the first and second input terminals of the comparator 53 are fixed to be "0", lateral stripes comprising two lines move downward. Furthermore, when the modifications shown in FIGS. 7 and 8 are combined, the lateral stripes comprising two lines move upward. In addition, the attribute data is written in the memory 3 in advance, but can be directly supplied from the circuit 1 to the controller 5.

Figure 9:
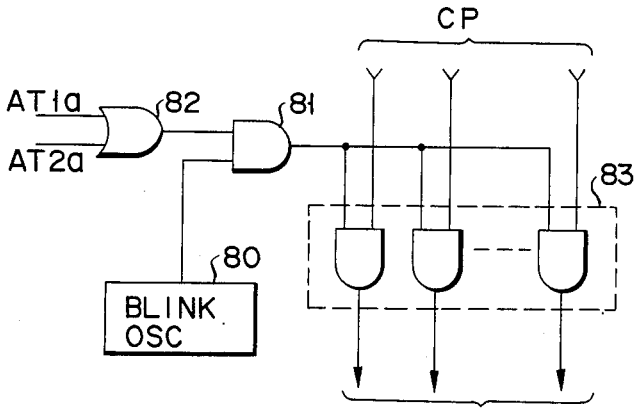
FIG. 9 is a detailed circuit diagram showing an attribute controller of a flat panel display device according to a second embodiment of the present invention.

A flat panel display device according to a second embodiment of the present invention will be described next. The overall arrangement of the second embodiment is the same as that of the first embodiment shown in FIG. 1. FIG. 9 is a block diagram of an attribute controller according to the second embodiment. A high-frequency pulse signal generated from a blink oscillator 80 is supplied to the first input terminal of an AND gate 81. The second input terminal of the AND gate 81 receives high-luminance display attribute bit AT1*a* or AT2*a* of attribute data AT1 and AT2 through an OR gate 82. The output from the AND gate 81 is supplied to the first input terminals of an AND gate array 83 comprising six AND gates equal to the number of bits of the character pattern CP. The second input terminals of the AND gate array 83 receive the respective bits of the character pattern CP from a character generator 4. The output signal from the array 83 corresponds to the character pattern AP with attribute data.

According to the second embodiment with the above arrangement, when the bit AT1*a* or AT2*a* is "1", the AND gate 81 is conductive, and the output from the oscillator 80 is supplied to the array 83. During a period wherein the output from the oscillator 80 is "1", the character pattern CP becomes the character pattern AP with attribute data. However, during a period wherein the output from the oscillator 80 is "0", since the array 83 is nonconductive, the character pattern CP cannot pass through the array 83, and is not displayed. That is, when the bit AT1*a* or AT2*a* is "1", the character pattern is blinked in accordance with the oscillating frequency of the oscillator 80.

According to the second embodiment, emphasized display as an alternative of high-luminance display can be performed, and a control apparatus for a flat panel display device having full compatibility with a CRT display device can be realized.

The present invention is not limited to the above embodiments. As an emphasized display mode as an alternative to high-luminance display, a lateral dotted stripe can be vertically moved, or a character font of the corresponding portion (e.g., using double dots) can be changed. Furthermore, these display modes can be combined. To summarize, when attribute data indicating high-luminance display attribute is supplied, instead of invalidating it, by performing another emphasized display a control apparatus for a flat panel display device having full compatibility with a CRT display device can be realized. The flat panel display device is not limited to an LCD, but can be a plasma display device, an EL display device or the like.

What is claimed is:

1. A flat panel display control apparatus comprising:

a flat panel display device for displaying each character by a plurality of dots in a matrix form;

pattern storing means for storing a character pattern of a character to be displayed;

means for storing attribute data of each character stored in said pattern storing means; and attribute control means for reading out the character pattern and the attribute data thereof, and for supplying the character pattern to said flat panel display device by superimposing a cyclically moving dot or dots on the character pattern when the attribute data indicates a high-light intensity display.

2. A flat panel display control apparatus according to claim 1, in which said attribute control means comprises means for generating a lateral stripe pattern which repeatedly moves in a vertical direction in a dot matrix constituting one character, and means for superimposing the repeatedly moving lateral stripe pattern on the character pattern when the attribute data indicates a high light intensity display.

3. A flat panel display control apparatus according to claim 2, in which said lateral stripe pattern generating means generates a lateral stripe pattern which repeatedly moves downward.

4. A flat panel display control apparatus according to claim 2, in which said lateral stripe pattern generating means generates a lateral stripe pattern which repeatedly moves upward.

5. A flat panel display control apparatus according to claim 1, in which said flat panel display device sequentially turns on dots of a dot matrix while two-dimensionally scanning the dots, and said attribute control means comprises an oscillator for generating a pulse signal having a frequency lower than that of vertical scanning of said flat panel display device, a counter for receiving the output pulse signal from said oscillator, a comparator for comparing an output from said counter and a scanning address line indicating a display line (horizontal line) of said flat panel display device and for generating a coincidence signal when coincidence therebetween is detected, and AND gate for receiving the coincidence signal generated from said comparator and a high-light intensity attribute signal, and an OR gate for receiving a pattern for one line of a character pattern designated by the scanning line address and the output from the AND gate.

6. A flat panel display control apparatus according to claim 5, in which said comparator compares the output from said counter and the scanning line address for each identical bit.

7. A flat panel display control apparatus according to claim 5, in which said comparator compares an inverted output from said counter and the scanning line address for each identical bit.

8. A flat panel display control apparatus according to claim 5, in which said comparator compares the output from said counter excluding a least significant bit and the scanning line address excluding a least significant bit for each identical bit.

9. A flat panel display control apparatus comprising:

means for generating a character dot pattern;

means for generating attribute data for the character pattern, the attribute data comprising a high-brightness attribute data;

means for generating an attribute dot pattern according to the attribute data, said means generating, in response to the high-brightness attribute data, a cyclically moving dot pattern; and display means comprising a flat panel display for superimposing the character dot pattern and the attribute dot pattern and for displaying the superimposed character dot pattern and attribute dot pattern.

10. The flat panel display control apparatus according to claim 9, in which said attribute dot pattern means generates a stripe dot pattern arranged in a first direction which is cyclically moved in a second direction perpendicular to the first direction in response to the high-brightness attribute data.

11. The flat panel display control apparatus according to claim 9, in which said attribute dot pattern means comprises means for logically ANDing the character dot pattern and the attribute dot pattern.

12. The flat panel display control apparatus according to claim 9, in which said character dot pattern generating means comprises means for generating a character dot pattern comprised of several scanning line components in units of one scanning line component by a first frequency, and in which said attribute dot pattern generating means comprises means for cyclically moving a dot pattern by a second frequency which is lower than the first frequency.

* * * * *